US011213110B1

(12) United States Patent
Soto

(10) Patent No.: US 11,213,110 B1
(45) Date of Patent: Jan. 4, 2022

(54) COSMETIC APPLICATOR

(71) Applicant: Ashley Soto, Howard Beach, NY (US)

(72) Inventor: Ashley Soto, Howard Beach, NY (US)

( * ) Notice: Subject to any disclaimer, the term of this patent is extended or adjusted under 35 U.S.C. 154(b) by 0 days.

(21) Appl. No.: 17/018,261

(22) Filed: Sep. 11, 2020

(51) Int. Cl.

| | |
|---|---|
| ***B43K 7/02*** | (2006.01) |
| ***A45D 40/24*** | (2006.01) |
| ***A45D 34/04*** | (2006.01) |
| ***A45D 40/20*** | (2006.01) |
| ***A46B 9/02*** | (2006.01) |
| ***A46B 11/06*** | (2006.01) |
| ***A46B 5/00*** | (2006.01) |

(52) U.S. Cl.
CPC ..... *A45D 40/24* (2013.01); *A45D 34/042* (2013.01); *A45D 40/205* (2013.01); *A46B 5/0095* (2013.01); *A46B 9/021* (2013.01); *A46B 11/06* (2013.01); *A45D 2040/208* (2013.01); *A45D 2200/053* (2013.01); *A46B 2200/1053* (2013.01)

(58) Field of Classification Search
CPC ..... A45D 40/18; A45D 40/24; A45D 34/06
USPC ..... 401/17, 18, 37, 38
See application file for complete search history.

(56) References Cited

U.S. PATENT DOCUMENTS

| | | | | |
|---|---|---|---|---|
| 6,637,963 | B2 * | 10/2003 | Huang | A45D 40/24 132/314 |
| 7,654,762 | B2 * | 2/2010 | Carlino | A45D 33/26 401/19 |
| 8,156,949 | B2 * | 4/2012 | Albert | A45D 33/26 132/297 |
| 8,397,931 | B2 * | 3/2013 | Palmer | A45D 40/18 220/4.27 |
| 10,349,724 | B2 * | 7/2019 | Lambdin | A45D 40/18 |
| 2015/0189973 | A1 * | 7/2015 | Swain | A45D 40/262 401/18 |

* cited by examiner

*Primary Examiner* — Jennifer C Chiang
(74) *Attorney, Agent, or Firm* — Andrew Morabito

(57) ABSTRACT

A multi-unit cosmetic applicator comprising; a body have a first end and a second end, wherein the first end has a threaded opening to a first internal compartment and the second end has an opening to a second internal compartment, a threaded cap with a brush sized to interface with the threaded opening, a first cosmetic agent housed within the first internal compartment and designed to interface with the brush, a cosmetic agent, a mechanism integrated into the opening of the second internal compartment, wherein the mechanism is able to independently advance the second cosmetic agent, a first cap sized to fit over the opening and secure to the body, wherein the cap has a brush secured to a top, and a second cap sized to fit over the brush and secure to the first cap.

8 Claims, 3 Drawing Sheets

COSMETIC APPLICATOR

BACKGROUND OF THE INVENTION

The present invention relates to a cosmetic applicator, and more particularly to a multi-purpose applicator.

Conventional applicators for applying mascara compositions to eyelashes generally include a brush having a single functionality. A regular or big size mascara brush, while being generally capable of depositing a cosmetic composition onto the eyelashes, lacks the ability or renders challenging to the user to apply the cosmetic composition in an accurate or detailed manner. Additionally, these conventional applicators are designed for one particular type of mascara or makeup product.

Cosmetic applicators are designed to deliver a cosmetic agent such as lip gloss, mascara, lip liner, concealer, foundation, eye shadow and eyeliner, etc. from a cosmetic unit. The cosmetic unit may be a solid, a liquid reservoir, or the like. Due to ease of design and manufacturing, applicators typically house only one cosmetic unit.

Thus, users must carry a variety of applicators. For example, when applying a lip gloss, it might be useful to also have a lip liner available. Thus, the user must remember to carry both items. This, of course, requires the number of items to carry and reduces the space needed to carry the items.

Even when a user carries all items with them, it may be that the cosmetic agents being used are incompatible. In the example above, the lip gloss may include ingredients that react adversely with the lip liner. The conflict may be relatively minor, liquefaction or smearing of one or the other cosmetic agent, to serious, burning or allergic reactions on the user's skin.

Thus, the person needs to purchase multiple different applicators for multiple different products, particularly for reaching the bottom eyelashes or eyelashes in corners of the eye. Therefore, to improve the ability to apply cosmetic compositions in a precise and detailed manner, a user must carry a variety of applicators, which is burdensome to the user.

It is desired to have a single applicator which can be used for a variety of different cosmetic compositions.

SUMMARY

Accordingly, it is an objective of the present invention a multi-unit cosmetic applicator comprising: a body have a first end and a second end, wherein the first end has a threaded opening to a first internal compartment and the second end has an opening to a second internal compartment; a threaded cap with a brush sized to interface with the threaded opening; a first cosmetic agent housed within the first internal compartment and designed to interface with the brush; a cosmetic agent; a mechanism integrated into the opening of the second internal compartment, wherein the mechanism is able to independently advance the second cosmetic agent; a first cap sized to fit over the opening and secure to the body, wherein the cap has a brush secured to a top; and a second cap sized to fit over the brush and secure to the first cap.

In a second embodiment the present invention is a multi-unit cosmetic applicator comprising: a body have a first section and a second section detachably secured together, wherein a first end a threaded opening to a first internal compartment and a second end has an opening to a second internal compartment; a threaded cap with a brush sized to interface with the threaded opening; a first cosmetic agent housed within the first internal compartment and designed to interface with the brush; a cosmetic agent; a mechanism integrated into the opening of the second internal compartment, wherein the mechanism is able to independently advance the second cosmetic agent; a first cap sized to fit over the opening and secure to the body, wherein the cap has a brush secured to a top; and a second cap sized to fit over the brush and secure to the first cap.

DETAILED DESCRIPTION OF THE INVENTION

Figure 1:
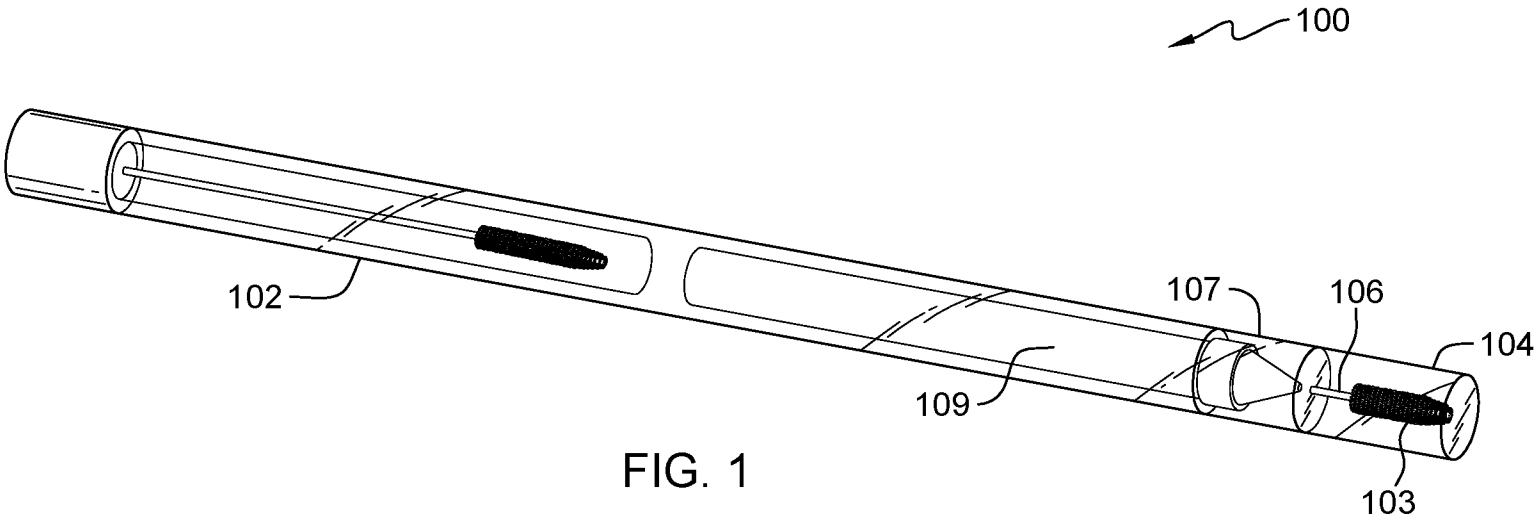
FIG. 1 depicts an isometric view of an applicator, in accordance with one embodiment of the present invention.

The present invention provides for an applicator which houses a variety of different cosmetic products, each product with the preferred applicator type and all concealed in a single applicator.

Herein, "cosmetic agent" is used to denote the cosmetic that is applied to the user, while "cosmetic unit" is used to designate the physical formation that includes the cosmetic agent. For example, the lipstick components that are used to cover and/or enhance the lips of the user are the cosmetic agent, while the molded, typically cylindrical, form of the lipstick transported and used from the applicator is the cosmetic unit. Similarly, the liquid in a reservoir would be the cosmetic agent, while the reservoir is the cosmetic unit. One skilled in the art would understand the above not to be an exhaustive list.

As will be apparent to those of skill in the art upon reading this disclosure, each of the individual embodiments described and illustrated herein has discrete components and features which may be readily separated from or combined with the features of any of the other several embodiments without departing from the scope or spirit of the present invention. It is to be understood that this invention is not limited to particular embodiments described, as such may, of course, vary. It is also to be understood that the terminology used herein is for the purpose of describing particular embodiments only, and is not intended to be limiting, since the scope of the present invention will be limited only by the appended claims.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, the preferred methods and materials are now described.

All publications and patents cited in this specification are herein incorporated by reference as if each individual publication or patent were specifically and individually indicated to be incorporated by reference and are incorporated herein by reference to disclose and describe the methods and/or materials in connection with which the publications are cited. The citation of any publication is for its disclosure prior to the filing date and should not be construed as an admission that the present invention is not entitled to antedate such publication by virtue of prior invention. Further, the dates of publication provided may be different from the actual publication dates which may need to be independently confirmed.

It must be noted that as used herein and in the appended claims, the singular forms "a", "an", and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements or use of a "negative" limitation.

Figure 2:
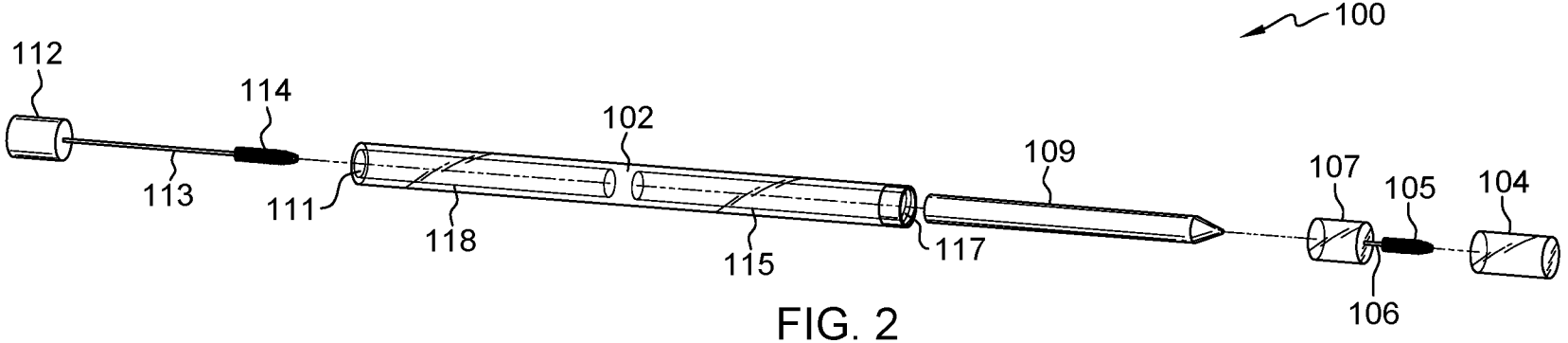
FIG. 2 depicts an exploded view of an applicator, in accordance with one embodiment of the present invention.
Figure 3:
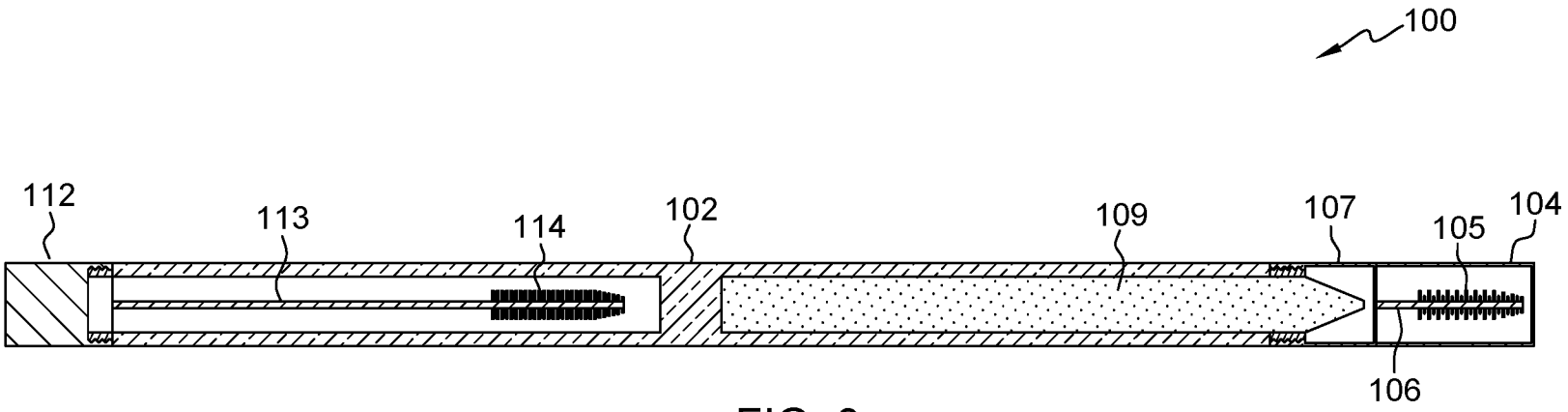
FIG. 3 depicts a section view of the applicator, in accordance with one embodiment of the present invention.

FIGS. 1-3 depicts a first embodiment of the present invention; a multi-unit cosmetic applicator includes a first roll-up/twist pencil that is used for eyebrows. A dispenser for an eyebrow set gel. A comb/brush for blending colors and brushing the eyebrow hairs.

The applicator 100 is shown in a stored position, wherein the cosmetics are contained and protected within the applicator 100 housing 102. Preferably, applicator 100 is made of plastic, metal, and/or thermoplastic elastomers, rubber, manufactured using blow molding, and assembled by snap-fit assembly. However, any other material, manufacturing, and/or assembly method may be used. Especially desired is to have certain portions of the housing made with anodized plastic materials to give an upscale and refined look.

The applicator 100 has a first applicator 103 concealed under cap 104. The cap 104 provides protection of the applicator 103. The first applicator 103 is a brush 105 attached to a shaft 106. The brush 105 has a predetermined texture and design based on the intended purpose of the brush 105. The brush 105 may be used for brushing or combing the eyebrows, blending colors on the skin, or the like. The cap 104 is designed to engage with the applicator body portion 107, this may be achieved through a threaded fastening means, a pressure fit, or the like. Applicator body portion 107 engages with the applicator body portion 102 and the applicator body portion 107 provides for a void in which the tip of pencil 109 to be protected. The applicator body portion 102 has two internal compartments 118 and 115 and each has a coincided opening. In the depicted embodiment, a mechanism 117 has a twist assembly, to permit the pencil 109 to be selectably moved relative to the applicator body portion 102. The second opening 111 has a threaded portion to allow the cap 112 to secure to the applicator body portion 102. The cap 112 has a shaft 113 attached to the brush 114, wherein an internal compartment 118 houses the cosmetics. This internal compartment 118 may be a reservoir for the mascara or the like. The cap 112 may have an internal compartment which can hold additional cosmetic items or products. The housing 102 may be detachable between the internal compartments 118 and 115 to allow for the removal and reattachment of various pieces when one of the applicators runs out or is no longer needed.

In some embodiments the brushes are detachable from the shafts.

The brushes 103 and 114 may be used for various cosmetic products and be redesigned based on the product to be applied. The applicators that may be used to apply product. For example, exemplary embodiments may include a support that has an elongate shape that defines one of a curved conical shape, a curved frustoconical shape, a curved prismatic shape, a straight prismatic shape, a feather-shape, or the like.

The internal compartment 118 and the internal compartment 115 may be switched or contain a cosmetic pencil (e.g., lip liner, eyeliner, eyebrow pencil, etc.), a brush (e.g., an eyeliner brush, an eyeshadow brush, a mascara brush, a concealer brush, etc.), a lipstick, a concealer stick, a comb, a sponge applicator, a foam applicator, and the like.

In the depicted embodiment, the cap 112 is 11.5 mm long and 8.9 mm wide, the internal compartment 118 is 59.1 mm long and 6 mm wide and the shaft 113 is 39.8 mm long and the brush 114 is 14.3 mm long and 3.0 mm wide. The body is 8.9 mm wide. The pencil portion of the body is 59.1 mm wide and the internal compartment 115 is 6.0 mm wide. The applicator body portion 108 104 is 11.5 mm long and 8.9 mm wide with a tapered designed so that the cap 104 17 mm long and 8.9 mm wide. The brush 105 is 9.4 mm long and 3.0 mm wide and attached to a shaft 103 which is 3.3 mm long.

In one embodiment, the pencil 109 has a sliding mechanism to move the pencil 109 upwards to be used. In some embodiments, the pencil 109 used a spring and a sleeve. Spring is biased against sleeve. Sleeve is substantially cylindrical and retains a lower portion of the pencil 109. Push button is biased against the exit of the pencil 109 tip, while spring is biased against the sleeve. In another embodiment to move the pencil 109 includes a twist assembly. Twist assembly includes a sleeve that houses the pencil 109. An upper portion of the twist assembly fits against the body. Therein, body is rotatable with respect to body and rotates with twist assembly. Thus, in essence, the lower portion of the cosmetic applicator rotates, while the upper portion of the body is still, and the cosmetic unit is advanced longitudinally. In the depicted embodiments, the pencil 109 and the housing 102 are threaded and the housing 102 has a mechanism 117 so when the mechanism 117 is rotated, the pencil 109 becomes more or less exposed based on the direction the mechanism 117 is rotated.

Present invention: should not be taken as an absolute indication that the subject matter described by the term "present invention" is covered by either the claims as they are filed, or by the claims that may eventually issue after patent prosecution; while the term "present invention" is used to help the reader to get a general feel for which disclosures herein that are believed as maybe being new, this understanding, as indicated by use of the term "present invention," is tentative and provisional and subject to change over the course of patent prosecution as relevant information is developed and as the claims are potentially amended.

The foregoing descriptions of various embodiments have been presented only for purposes of illustration and description. They are not intended to be exhaustive or to limit the present invention to the forms disclosed. Accordingly, many modifications and variations of the present invention are possible in light of the above teachings will be apparent to practitioners skilled in the art. Additionally, the above disclosure is not intended to limit the present invention. In the specification and claims the term "comprising" shall be understood to have a broad meaning similar to the term "including" and will be understood to imply the inclusion of a stated integer or step or group of integers or steps but not the exclusion of any other integer or step or group of integers or steps. This definition also applies to variations on the term "comprising" such as "comprise" and "comprises".

Although various representative embodiments of this invention have been described above with a certain degree of particularity, those skilled in the art could make numerous alterations to the disclosed embodiments without departing from the spirit or scope of the inventive subject matter set forth in the specification and claims. Joinder references (e.g. attached, adhered, joined) are to be construed broadly and may include intermediate members between a connection of elements and relative movement between elements. As such, joinder references do not necessarily infer that two elements are directly connected and in fixed relation to each other. Moreover, network connection references are to be construed broadly and may include intermediate members or devices between network connections of elements. As such, network connection references do not necessarily infer that two elements are in direct communication with each other. In some instances, in methodologies directly or indirectly set forth herein, various steps and operations are described in one possible order of operation, but those skilled in the art will recognize that steps and operations may be rearranged, replaced or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

Although the present invention has been described with reference to the embodiments outlined above, various alternatives, modifications, variations, improvements and/or substantial equivalents, whether known or that are or may be presently foreseen, may become apparent to those having at least ordinary skill in the art. Listing the steps of a method in a certain order does not constitute any limitation on the order of the steps of the method. Accordingly, the embodiments of the invention set forth above are intended to be illustrative, not limiting. Persons skilled in the art will recognize that changes may be made in form and detail without departing from the spirit and scope of the invention. Therefore, the invention is intended to embrace all known or earlier developed alternatives, modifications, variations, improvements and/or substantial equivalents.

While this invention has been described in conjunction with the specific embodiments outlined above, it is evident that many alternatives, modifications and variations will be apparent to those skilled in the art. Accordingly, the preferred embodiments of the invention, as set forth above, are intended to be illustrative, not limiting. Various changes may be made without departing from the spirit and scope of this invention.

What is claimed is:

1. A multi-unit cosmetic applicator comprising:

a body having a first end and a second end, wherein the first end has a threaded opening to a first internal compartment and the second end has an opening to a second internal compartment;

a threaded cap with a brush sized to interface with the threaded opening;

a first cosmetic agent housed within the first internal compartment and designed to interface with the brush;

a second cosmetic agent;

a mechanism integrated into the opening of the second internal compartment, wherein the mechanism is able to independently advance the second cosmetic agent;

a first cap sized to fit over the opening of the second internal compartment and secure to the body, wherein the first cap has a brush secured to a top; and a second cap sized to fit over the brush and secure to the first cap.

2. The multi-unit cosmetic applicator of claim 1, wherein the brush is substantially similar to the brush.

3. The multi-unit cosmetic applicator of claim 1, wherein the second cap is threaded to mate with a threaded end of the first cap.

4. A multi-unit cosmetic applicator comprising:

a body having a first section and a second section detachably secured together, wherein a first end has a threaded opening to a first internal compartment and a second end has an opening to a second internal compartment;

a threaded cap with a brush sized to interface with the threaded opening;

a first cosmetic agent housed within the first internal compartment and designed to interface with the brush;

a second cosmetic agent;

a mechanism integrated into the opening of the second internal compartment, wherein the mechanism is able to independently advance the second cosmetic agent;

a first cap sized to fit over the opening of the second internal compartment and secure to the body, wherein the first cap has a brush secured to a top; and a second cap sized to fit over the brush and secure to the first cap.

5. The multi-unit cosmetic applicator of claim 4, wherein the brush is substantially similar to the brush.

6. The multi-unit cosmetic applicator of claim 4, wherein the second cap is threaded to mate with a threaded end of the first cap.

7. The multi-unit cosmetic applicator of claim 4, wherein the mechanism and the cosmetic agent are threaded.

8. The multi-unit cosmetic applicator of claim 4, wherein the brush is detachable from a shaft.

* * * * *